US005337921A

United States Patent [19]

Wilson et al.

[11] Patent Number: 5,337,921

[45] Date of Patent: Aug. 16, 1994

[54] DETACHABLE RECEPTACLE AND FITTED POUCHES FOR REFILLABLE SPRAYER DEVICES

[75] Inventors: Daniel C. Wilson, Midland, Mich.; Kenneth E. Klaber, Reynoldsburg, Ohio

[73] Assignee: Dowbrands Inc., Indianapolis, Ind.

[21] Appl. No.: 62,887

[22] Filed: May 17, 1993

[51] Int. Cl.[5] ..... B67D 5/00

[52] U.S. Cl. ..... 222/105; 222/383

[58] Field of Search ..... 222/95, 156, 105, 383, 222/325, 321, 183, 541; 222/386.5

[56] References Cited

U.S. PATENT DOCUMENTS

| | | | |
|---|---|---|---|
| D. 255,776 | 7/1980 | Britt | 222/383 X |
| 1,450,055 | 3/1923 | Trumbull | 222/105 |
| 2,557,120 | 6/1951 | Knoblock | 222/105 X |
| 3,155,279 | 11/1964 | Ferguson, Jr. | 222/105 X |
| 3,217,933 | 11/1965 | Watson, Jr. | 222/105 X |
| 3,223,289 | 12/1965 | Bouet | 222/95 X |
| 3,486,661 | 12/1969 | Friedrich et al. | 222/95 |
| 4,595,126 | 6/1986 | Holmes | 222/105 |
| 4,614,284 | 9/1986 | Miles | 222/383 X |
| 4,932,563 | 6/1990 | Diamond | 222/129 |
| 5,004,123 | 4/1991 | Stoody | 222/150 X |
| 5,031,798 | 7/1991 | Wild | 222/105 X |
| 5,056,685 | 10/1991 | Wild | 222/105 X |
| 5,085,346 | 2/1992 | Wright | 222/156 X |
| 5,156,299 | 10/1992 | De Caluwe et al. | 222/105 X |

*Primary Examiner*—Kevin P. Shaver

[57] ABSTRACT

This invention relates to a spraying apparatus comprising a detachable refill pouch said pouch designed to contain fluid, and a sprayer device detachably connected to the refill pouch and a receptacle device held therebetween the refill pouch and sprayer. The pouch is held in place by detachably connecting the pouch directly to the sprayer with the receptacle held therebetween. The pouch has a neck portion made of material to provide sufficient integrity to allow for mounting of the neck to a cap on a sprayer.

11 Claims, 4 Drawing Sheets

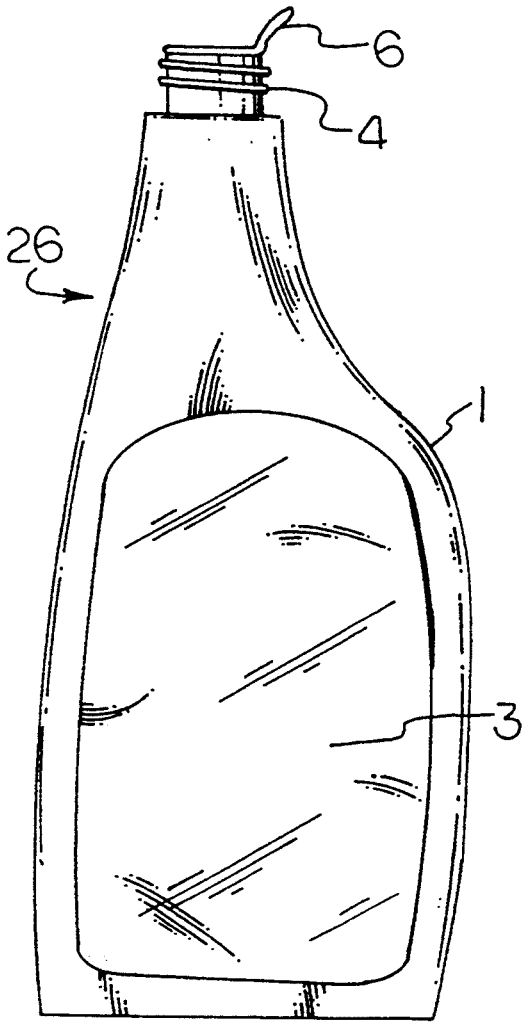
FIG. 3
FIG. 4
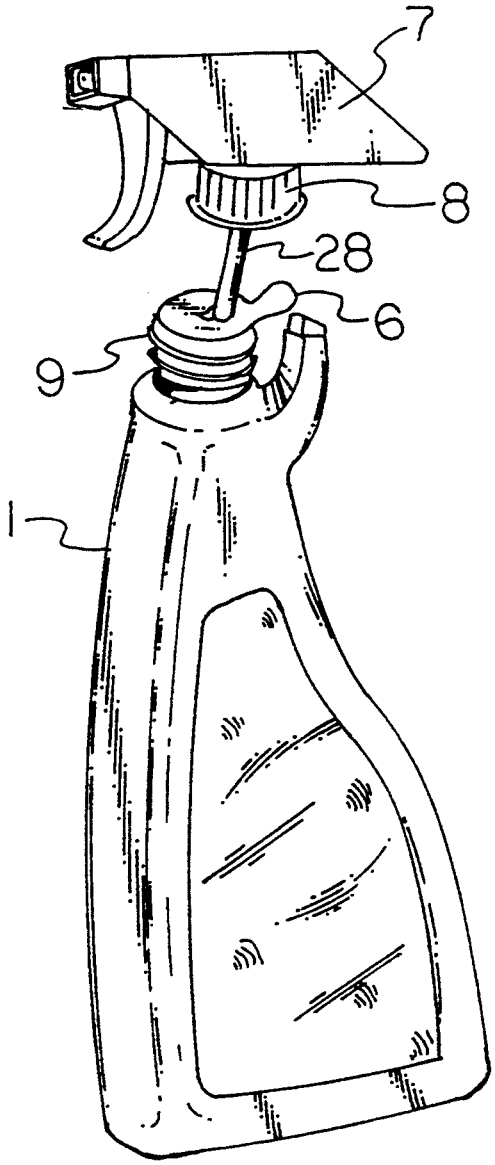

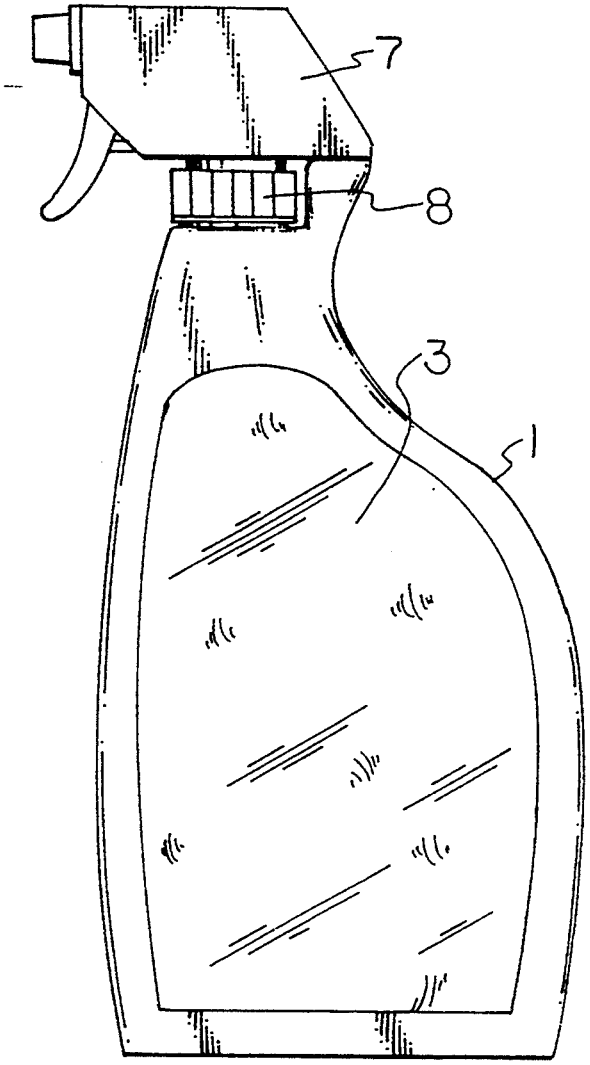
FIG. 5
FIG. 6
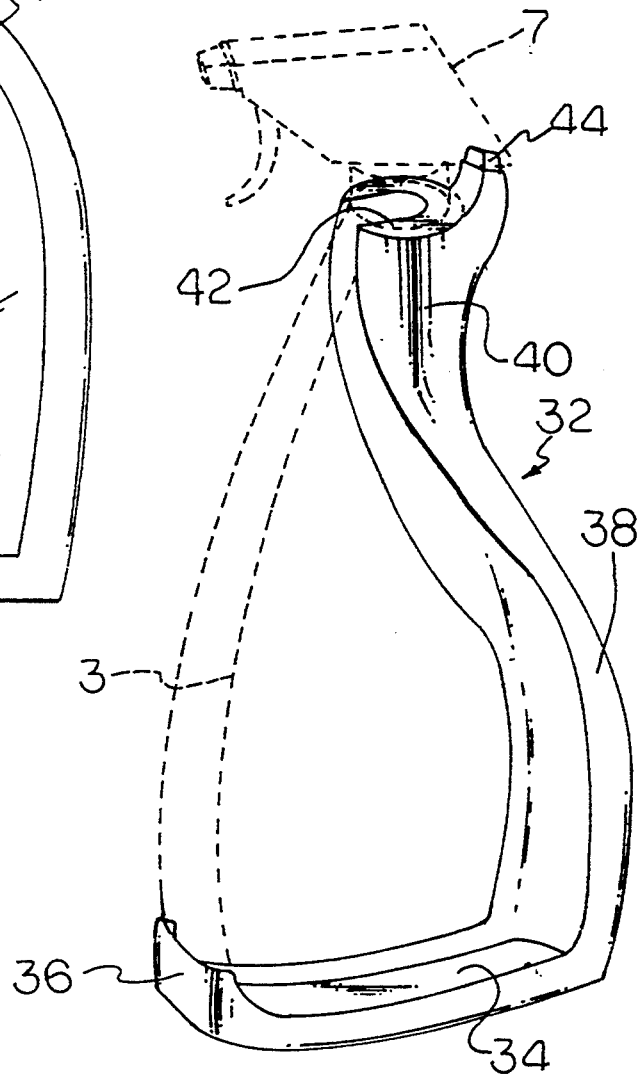

DETACHABLE RECEPTACLE AND FITTED POUCHES FOR REFILLABLE SPRAYER DEVICES

This invention relates to an apparatus comprising a detachable refill pouch said pouch designed to contain fluid, and a sprayer device detachably connected to the refill pouch and a receptacle device held therebetween the refill pouch and sprayer.

BACKGROUND OF THE INVENTION

The market has dictated a need for less waste in plastic containers and refillable plastic containers have become increasingly necessary to prevent waste.

Refilling conventional sprayer bottles with liquid from refill containers requires excessive handling by the consumer and undesirable exposure to the liquid by the consumer. Devices to solve this problem have been proposed but are lacking in practical application. The device disclosed in U.S. Pat. No. 5,056,685 describes a sprayer undesirably attached to a holder for a pouch, thereby requiring a sleeve to hold the pouch in place and several undesirable steps for a consumer to attach the pouch to the sprayer.

Accordingly, a receptacle device of the present invention securely holds a pouch in place by detachably connecting the pouch directly to the sprayer with the receptacle held therebetween; the receptacle enabling the consumer to easily assemble the pouch and receptacle and grasp the spraying device to comfortably spray the fluid from the pouch. The receptacle is held in place between the sprayer and pouch and provides integrity to the device for the user to comfortably hold the device. The spraying device will typically utilize conventional sprayers currently available on the market.

The plastic typically required for a refillable bottle cannot typically be made from 100 percent post consumer recycled plastic. The plastic must be made from a percentage of unprocessed plastic in order for the bottle to adequately contain the contents.

Accordingly, the present invention also utilizes a receptacle device which is not in direct contact with the contents of the pouch to be dispensed and therefore can be made with a light weight plastic and/or up to one hundred percent post-consumer recycled plastic.

Typical pouches that are merely fluid filled bags are typically difficult to fill during production because as they index through a filling station during production, the product sloshes up along the inside walls of the pouches and the interior of the pouch becomes moistened, which prevents a leakproof seal from being formed.

Accordingly, the present invention also comprises a pouch having a neck portion made of material to provide sufficient integrity to allow for mounting of the neck to a cap on a sprayer. The integrity of the neck portion will allow machinery to grab the collar of the neck portion to hold the pouch in place for filling during production. Additionally, the walls of the pouch will not require a seal once filled thereby eliminating the difficult step of sealing a moistened pouch. The pouch of the present invention may be sealed by covering the opening of the the upper neck portion with a foil or frangible seal or other sealable means.

SUMMARY OF THE INVENTION

A spraying apparatus for packaging and dispensing liquid consumer products, such as household cleaners, comprising a reusable generally rigid receptacle device as a holder for a disposable or refillable detachable generally flexible pouch for containing the liquid. The receptacle includes an opening intended to remain unclosed in its bottom or side for inserting the pouch into the receptacle, and a fitment for removably securing the pouch to the top of the receptacle as well as a dispensing sprayer sealingly secured to the open orifice of said pouch.

BRIEF DESCRIPTION OF THE DRAWINGS

FIG. 3 is a side elevational view of the pouch inserted into the receptacle device;

FIG. 4 is an isometric view of the receptacle device with inserted pouch of FIG. 3 with a sprayer being inserted into the pouch;

FIG. 5 is a side elevational view of a preferred embodiment of an assembled sprayer apparatus of the present invention;

FIG. 6 is an isometric view of a modified form of a receptacle device of the present invention with a pouch sprayer being shown in phantom as it would be assemble therewith.

DETAILED DESCRIPTION OF THE INVENTION

Figure 1:
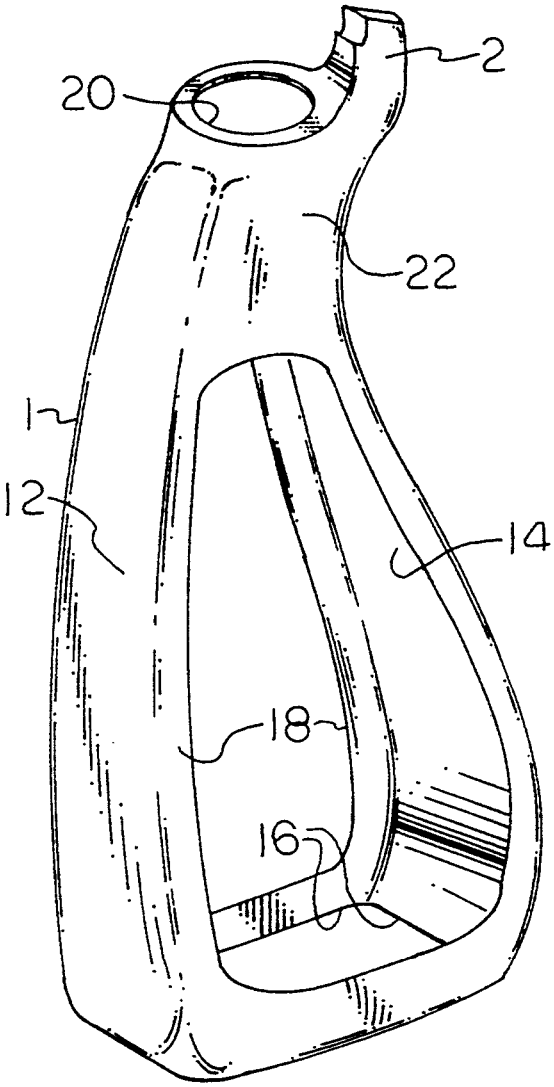
FIG. 1 is an isometric view of a receptacle device in accordance with the present invention.

The apparatus of the present invention will typically comprise a sprayer mechanism to a pouch and a receptacle. The pouch is securely held in place by detachably connecting the pouch directly to the sprayer with the receptacle held therebetween. The receptacle enables the consumer to easily assemble the pouch and receptacle and grasp the spraying device to comfortably spray the fluid from the pouch. The spraying apparatus will typically utilize conventional sprayers currently available on the market.

The mounting of the sprayer to the pouch can occur by bayonet fit, snap bead or other interference fitments conventionally known in the dispensing means art. Typically the sprayer and pouch will be threadably mounted; that is, the pouch may comprise a neck portion which may have threads on the upper neck portion and a collar on the lower neck portion and the sprayer may comprise a threaded screw cap wherein the threads on the upper neck portion of the pouch may screwably connect with the complementary threads on the screw cap of the sprayer which may form the detachable connection between the sprayer and the pouch.

The receptacle comprises a pouch neck orifice through which the neck of the pouch is received and a flange just below the orifice to mountably communicate with the collar of the neck portion of the pouch to prevent the pouch from passing through the pouch neck orifice in the receptacle and to stabilize the pouch when the pouch is connected to the screw cap of the sprayer.

The pouch can be prepared from a variety of plastic materials available such as polyethylene, polypropylene, polyester terephthalate and nylon for example and can have a variety of pliable or flexible film-like character or rigid or stiff physical forms based on the relative combinations of polymers chosen. If the pouch will fit within the receptacle device and sealably contain the contents of the pouch, the physical form for function of the pouch is not critical. The pouch will, however, be made with the least amount of material necessary to contain the liquid contents. The pouch is meant to utilize between 60 and 70 percent less (or less) plastic than a plastic bottle of a size meant to hold the same volume of liquid. The standard plastic sprayer bottle is meant to provide structural integrity to the bottle as well as hold the liquid contents. However, the receptacle device of the present invention serves the purpose of providing the structural integrity of a heavier sprayer bottle without needing to contain the liquid contents, while the pouch serves the purpose of providing the containment of the liquid without needing to provide structural support. Therefore, the pouch will require a lesser amount of resin than a conventional sprayer bottle.

The neck of the pouch, however, is to be made of resin which will provide sufficient integrity to allow for threadable mounting of the neck to a screw cap on a sprayer. The integrity of the neck portion will also allow machinery to grab the collar of the neck portion to hold the pouch in place for filling during production. The pouch may be sealed after filling by covering the opening of the upper neck portion with a foil seal or other sealable means.

The receptacle device can be thermoformed, blow-molded or injection-molded and can be made with a light weight plastic and/or up to one hundred percent post-consumer recycled plastic. The controlling factor for choosing plastic and amounts of plastic necessary to make the receptacle is the physical form requirements of the receptacle. The receptacle needs sufficient integrity to enable a consumer to grip the receptacle and utilize the sprayer.

The receptacle may also have a pummel or other sprayer stabilizer which fits into the rear portion of the sprayer to retain the sprayer in place and prevent the sprayer from swiveling around the top of the receptacle device when a user is attempting to use the sprayer apparatus.

The following are illustrative embodiments of the invention but are not meant to be limiting in scope. More particularly, the preferred embodiments of the present invention are illustrated in the drawings.

Figure 2:
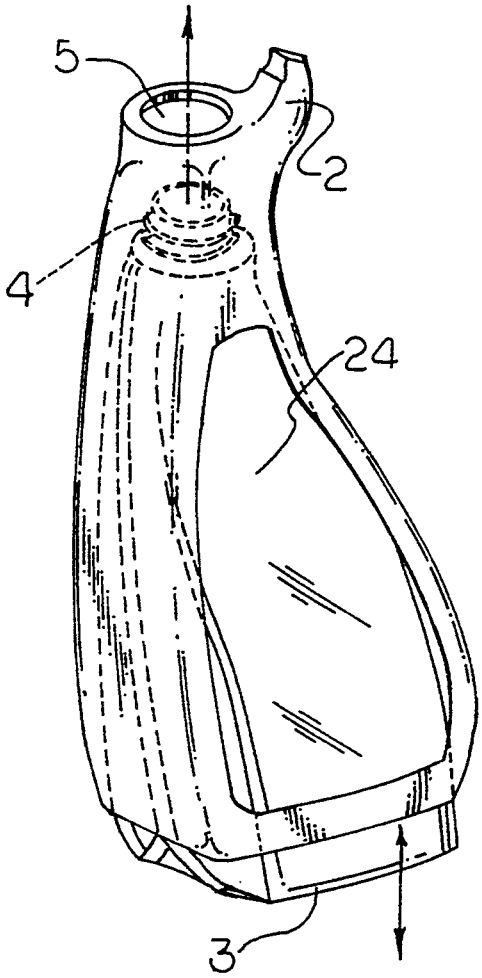
FIG. 2 is an isometric view of the receptacle device of FIG. 1 with a pouch being inserted thereinto.

In FIG. 1 an empty receptacle device or holder 1 is shown having a closed front wall 12, a closed rear wall 14, an open bottom defined by peripheral margins 16, open side walls 18 and a neck 20 having a neck orifice 5 in FIG. 2 adjacent the necks upper extremity 22, whereby the bottom wall 12 forms an uncloseable opening to allow for insertion of a refill pouch and both sides of the device are open to allow for viewing graphics on the refill pouch. At the top of the receptacle device is a spraying stabilizer device or pummel to hold a sprayer in place after the sprayer is connected to the refill pouch as illustrated in FIG. 5 later described.

In FIG. 2 refill pouch 3 having a main body portion 24 with a narrow integral neck portion 4 of the pouch 3 is inserted into the receptacle device with the neck portion 4 fitting through the neck orifice 5 of the receptacle device.

FIG. 3 illustrates pouch 3 fitted within the receptacle device 1. A foil seal 6 is sealed over the top of neck 4 the refill pouch which can either be pierced by a dip tube 28 of a trigger sprayer 7 as illustrated in FIG. 4 or removed by the consumer by peeling or tearing.

FIG. 4 shows the insertion of the tube 8 of sprayer 7 into the pouch through the seal 6 of the pouch 3 and a sprayer cap 8 threadably communicating with the pouch neck threads 9 mounting the pouch to the sprayer in a conventional manner.

In FIG. 5 there is shown a spraying apparatus 30 assembled with the sprayer cap 8 mounting the neck 4 threads 9 of pouch 3 to the sprayer 7 and thereby securing pouch 3 to receptacle 1 for use.

FIG. 6 demonstrates modified receptacle device 32 having a closed bottom wall 34, a short front wall 36 extending from said bottom wall so that said front wall is essentially open, with essentially open side walls 38, a neck area 40 ending in a partially opened (can be closed) neck 42 with pummel 44. Pouch 3 is merely slipped through the opening above front wall 3 and set on bottom wall 34 with the pouches neck portion inserted through neck orifice 42 and secured thereto in a manner like that in the embodiment of FIG. 5, whereby an uncloseable opening to receive the pouch is on the side of the receptacle device. Again the receptacle device in this embodiment has a sprayer stabilizer pummel and an opening in side walls for graphics display as well as an opening for the pouch.

Figure 7:
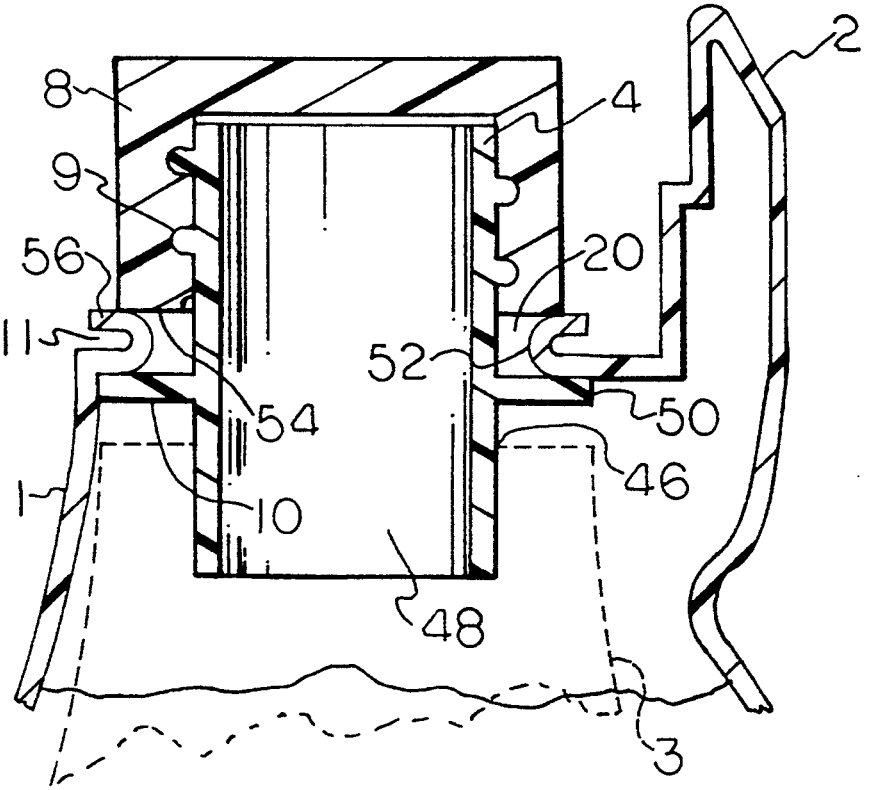
FIG. 7 is a partial enlarged cross-sectional view of a fitment collar assembled to the neck portion of the pouch illustrated in FIG. 2.

FIG. 7 illustrates a sprayer cap 8 with a collar 10 on the upper neck portion 4 of the pouch 3 and a flange 11 (here shown as a crimped edge for rigidity) at the neck orifice 20 of the receptacle device 1 to mountably communicate with the collar 10 of the neck portion 4 of the pouch to prevent the pouch 3 from passing through the pouch neck orifice 20 in the receptacle device and to stabilize the pouch when the pouch is threadably connected by way of thread to the screw cap 8 of the sprayer (sprayer not shown to simplify but can be like sprayer 7 shown earlier). Upper segment 46 forming an orifice in pouch 3 so that the interior 48 of neck 4 is in open communication with the interior of pouch 3. The outermost diameter of collar 10 formed by edge 50 is greater than the inner diameter of the receptacle orifice 20 defined by the inner orifice 52 of flange 11 so that movement of neck 4 beyond the lower surface of flange 11 is prevented. The outer diameter of cap 8 is also greater than the inner diameter of flange 11 such that the lower surface 54 of the cap engages the upper surface or shoulder 56 of flange 11 when screwed down on threads 9 of neck 4. Thus, by fully engaging the cap 8 segment 50 of neck 4 protruding beyond orifice 20 the flange 11 is trapped between collar 10 and cap 8 to removably secure the pouch 3 to receptacle device 1.

It is evident to one skilled in the art that various modifications of the present invention to provide a disposable or refillable pouch for containing liquids for consumer household care products and the like carried in a reusable holder for dispensing by spraying or otherwise can be provided in accordance with principles and concepts of the invention described hereinabove.

What is claimed is:

1. A sprayer apparatus for liquid products comprising a pouch for containing the liquid, said pouch having secured to an open upper extremity thereof a neck in open communication with the interior of said pouch, a generally upright rigid holder for said pouch, said holder comprising a receptacle of a shape generally similar to that of said pouch and having an opening in its bottom or side that remains open sufficient to permit said pouch to be inserted therethrough, said receptacle including a peripheral flange defining an orifice through which the neck of said pouch can pass, means on said neck to limit the passage of said neck through said orifice, and a sprayer device including a cap removably securable to said neck protruding through said orifice, both said cap and said neck means defining diameters greater than the inside diameter of said orifice whereby when said cap is secured on said neck, said cap and said neck means secure the neck and its pouch to said receptacle.

2. A sprayer apparatus of claim 1 wherein said receptacle comprises a sprayer stabilizer and said sprayer comprises a receptacle portion for receiving said sprayer stabilizer wherein said sprayer stabilizer inserts into the receptacle portion.

3. A sprayer apparatus of claim 1 wherein the pouch neck includes threads on its upper neck portion and the sprayer cap includes threads wherein the threads on the upper neck portion of the pouch screwably connect with the complementary threads on the screw cap of the sprayer for forming a detachable connection between the sprayer and the pouch.

4. A sprayer apparatus of claim 3 wherein the neck means of the pouch comprises a collar on a lower portion of said neck the receptacle flange mountably communicates with the collar of the neck portion of the pouch wherein the pouch is prevented from passing through the receptacle and the pouch is held in place when the pouch is threadably connected to the screw cap of the sprayer.

5. A sprayer apparatus of claim 1 wherein the pouch is sealed at the top of the neck portion with a film whereby the pouch is impermeable to liquid leaks,

6. A sprayer apparatus of claim 1 wherein the receptacle comprises a cut out window to enable visibility of the pouch within the receptacle.

7. A sprayer apparatus of claim 1 wherein the sprayer cap is secured to the pouch neck by a bayonet coupling.

8. A sprayer apparatus of claim 1 wherein the sprayer cap is secured to the pouch neck by a snap bead coupling.

9. A sprayer apparatus of claim 1 wherein the receptacle is made entirely from recycled resin.

10. A sprayer apparatus of claim 1 wherein the pouch is a refillable container.

11. A sprayer apparatus of claim 1 wherein the pouch is a flexible film-like container.

* * * * *

UNITED STATES PATENT AND TRADEMARK OFFICE

CERTIFICATE OF CORRECTION

PATENT NO. : 5,337,921

DATED : August 16, 1994

INVENTOR(S) : Daniel C. Wilson, Kenneth E. Klaber

It is certified that error appears in the above-identified patent and that said Letters Patent is hereby corrected as shown below:

Col. 5, line 15 delete "neck".
Col. 5, line 18 delete "complementary".

Signed and Sealed this

Twenty-third Day of May, 1995

*Attest:*

Bruce Lehman

BRUCE LEHMAN

*Attesting Officer*

*Commissioner of Patents and Trademarks*